US008333639B2

(12) United States Patent
Collister et al.

(10) Patent No.: US 8,333,639 B2
(45) Date of Patent: Dec. 18, 2012

(54) RIDGE VENT WITH BIOCIDAL SOURCE

(76) Inventors: Kenneth F. Collister, North Branch, MI (US); Brenden J. Jones, Elgin, IL (US)

( * ) Notice: Subject to any disclaimer, the term of this patent is extended or adjusted under 35 U.S.C. 154(b) by 1171 days.

(21) Appl. No.: 11/199,747

(22) Filed: Aug. 9, 2005

(65) Prior Publication Data

US 2006/0035582 A1 Feb. 16, 2006

Related U.S. Application Data

(60) Provisional application No. 60/600,191, filed on Aug. 10, 2004.

(51) Int. Cl.
*F24F 7/02* (2006.01)

(52) U.S. Cl. ..... 454/365; 454/364

(58) Field of Classification Search ..... 454/365
See application file for complete search history.

(56) References Cited

U.S. PATENT DOCUMENTS

| | | | | | |
|---|---|---|---|---|---|
| 1,701,926 | A | | 2/1929 | Kirschbraun | |
| 3,311,047 | A | * | 3/1967 | Smith et al. | 454/365 |
| 3,479,130 | A | | 11/1969 | Rapaport | |
| 3,494,727 | A | | 2/1970 | Rapaport | |
| 4,212,913 | A | | 7/1980 | Auten | |
| 4,276,732 | A | | 7/1981 | Nielsen | |
| 4,325,290 | A | * | 4/1982 | Wolfert | 454/365 |
| 4,554,862 | A | * | 11/1985 | Wolfert | 454/365 |
| 4,643,080 | A | * | 2/1987 | Trostle et al. | 454/365 |
| 4,977,721 | A | | 12/1990 | Blosseville et al. | |
| 5,052,286 | A | * | 10/1991 | Tubbesing et al. | 454/365 |
| 5,119,604 | A | | 6/1992 | Peterson et al. | |
| 5,216,864 | A | | 6/1993 | Urgero | |
| 5,772,502 | A | * | 6/1998 | Smith | 454/365 |
| 2001/0019941 | A1 | * | 9/2001 | Headrick | 454/365 |
| 2003/0198813 | A1 | | 10/2003 | Howell | |

OTHER PUBLICATIONS

Cobra Rigid Vent II, GAF Materials Corporation http://www.gaf.com/Content/GAF/RES1/ROOF/V_RidgeVents.pdf.

* cited by examiner

*Primary Examiner* — Steven B McAllister
*Assistant Examiner* — Helena Kosanovic
(74) *Attorney, Agent, or Firm* — Honigman Miller Schwartz and Cohn LLP

(57) ABSTRACT

An improved ridge vent that includes a support, a cover, a housing, and a concealing structure provides ventilation for a building. The housing contains a biocidal source. Rainwater flows down the cover, into the housing, and over the biocidal source. The water treated with the biocidal source then flows out of the housing and down the roof, inhibiting the growth of mold, moss, bacteria, and fungus. The concealing structure hides the biocidal source from view.

6 Claims, 4 Drawing Sheets

RIDGE VENT WITH BIOCIDAL SOURCE

CROSS-REFERENCE TO RELATED APPLICATION

This application claims priority to U.S. Provisional Patent Application Ser. No. 60/600,191, filed Aug. 10, 2004, which is hereby incorporated by reference.

TECHNICAL FIELD

This invention relates generally to ridge vents for roofs, and more specifically to ridge vents that contain a biocidal source to prevent the growth of unwanted biological matter such as moss, mold, bacteria, and fungus.

BACKGROUND OF THE INVENTION

Growth of biological matter can be a problem for shingled roofs. For example, moss, mold, bacteria, and fungus can cause unsightly discoloration of the shingles. This matter can also shorten the lives of the shingles, requiring costly replacement.

Skilled artisans often place a biocidal source on the roof to prevent the growth of biological matter. Such biocidal sources usually include an ionic metal such as zinc, copper, or lead. The biocidal source is typically placed near the top of the roof in strips. Rainwater dissolves some of the biocide as it runs over the strip. The rainwater then carries the biocide over the shingles below the strip as the rainwater continues down the roof. The scattered biocide thus prevents the growth of unwanted biological matter below the strips.

Biocidal strips can be unsightly themselves. The strips have a metallic look that does not blend in with the shingles. In addition, a strip of biocidal source about one inch wide is required to provide proper coverage for just ten feet of shingles. Therefore, either a wide strip must be installed to cover an entire side of a typical roof, or several strips must be installed on each side of the roof.

In the prior art, Nielson attempted to avoid the use of strips in U.S. Pat. No. 4,276,732 by using a trough containing a biocidal source. The '732 patent is not subtle in appearance, however, due to its large size and metallic outer surface. In addition, the trough contains a series of small holes for water to drain out. The distance between the holes creates gaps in the water coverage as the water flows down the roof. Gaps in the water coverage can cause unsightly streaks on the roof.

Wolfert attempted to combine a biocidal source with a ridge vent in U.S. Pat. No. 4,554,862. The '862 ridge vent is composed primarily of zinc. Therefore, the invention has the problem of being aesthetically unappealing, like the zinc strips, because it stands out from the shingles due to the zinc's metallic appearance. In addition, the '862 invention discloses large gaps between the drain holes in the ridge vent. The large gaps can cause streaking due to uneven water coverage on the roof.

SUMMARY OF THE INVENTION

The inventors of the present invention have recognized these and other problems associated with using biocidal sources on roofs to inhibit the growth of biological matter. To this end, the inventors have developed a biocidal structure that prohibits the growth of biological matter on the roof and conceals the biocidal source.

Specifically, the invention is a biocidal structure for use with a roofing vent. The biocidal structure comprises a housing carrying a biocidal source. A concealing structure is located adjacent the biocidal source and hides the biocidal source.

An alternative embodiment of the invention may further include a ridge vent. The ridge vent generally includes a vent support adapted to be disposed on the roof. A vent cover is attached to the top of the support to extend over the roof.

According to another conception of the invention, there is a method for controlling growth of biological matter on a roof having a ridge vent. The method including the steps of disposing a biocidal source downstream of a ridge vent so that water running off the ridge vent contacts the biocidal source before continuing down the roof. The method also includes concealing the biocidal source with a concealing structure to minimize visibility of the biocidal source.

FIGURES IN THE DRAWINGS

The present invention will now be described, by way of example, with reference to the accompanying drawings, in which.

DETAILED DESCRIPTION

Figure 1:
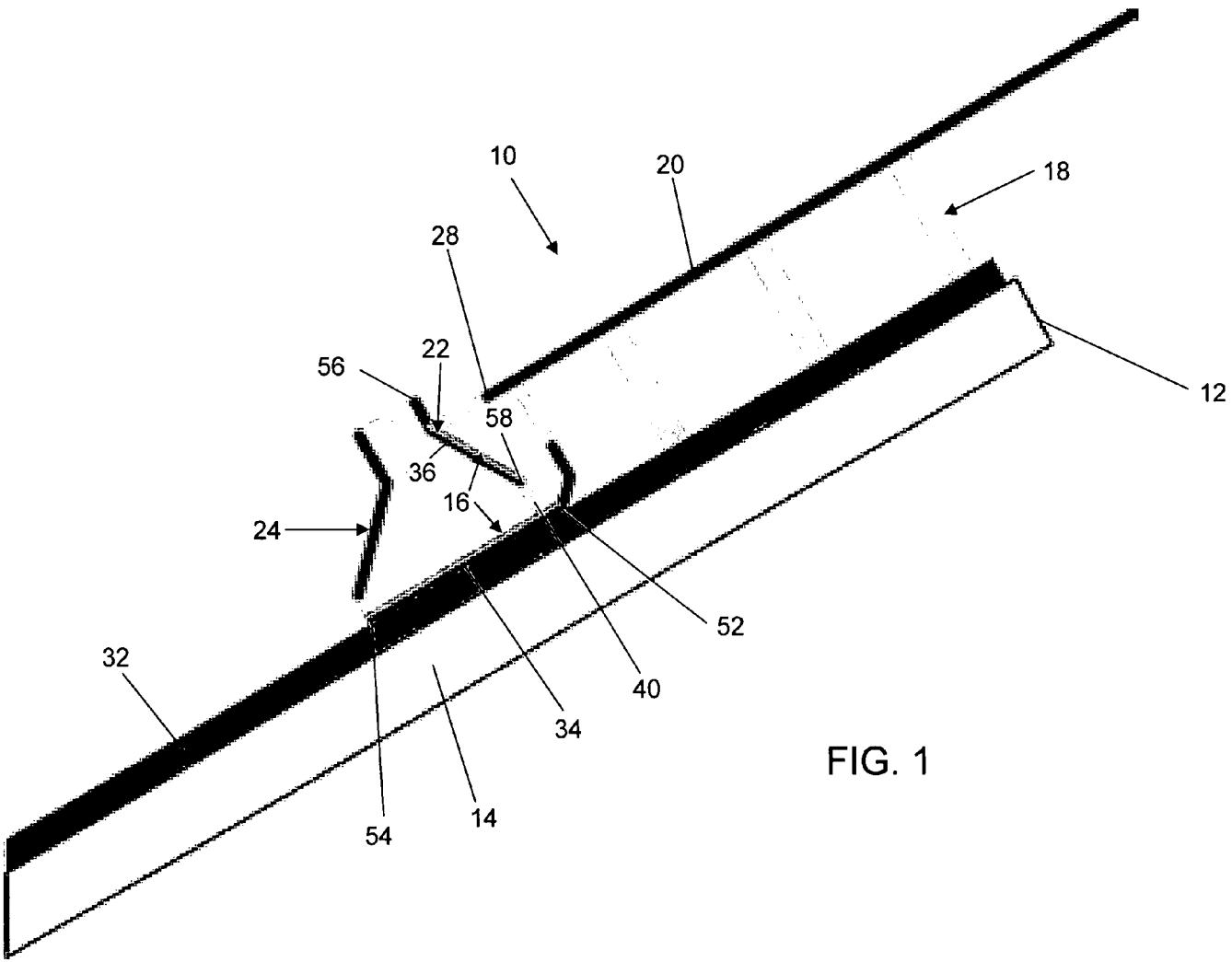
FIG. 1 is a sectional view of a one-sided ridge vent according to this invention.

The present invention will now be described, by way of example, with reference to the accompanying drawings in which a biocidal structure is generally shown at 10.

An embodiment of the invention is a biocidal structure 10 for use with a roofing vent 12. Biocidal structure 10 comprises a housing generally indicated at 22. A biocidal source generally indicated at 16 is carried by housing 22. A concealing structure generally indicated at 24 is located adjacent to biocidal source 16. Concealing structure 24 hides the biocidal source 16.

An alternative embodiment of the invention may further include a ridge vent assembly 10 comprising a support generally indicated at 18 and a vent cover generally indicated at 20.

Generally, ridge vent assembly 10 provides ventilation to a building through a vent 12 in a roof 14 as shown in FIG. 1. Ridge vent assembly 10 also provides a biocidal source generally indicated at 16 to inhibit the growth of moss, mold, bacteria, and fungus on the roof 14. Ridge vent assembly 10 generally includes a vent support 18, a vent cover 20, a housing generally indicated at 22, and a concealing structure generally indicated at 24.

Figure 2:
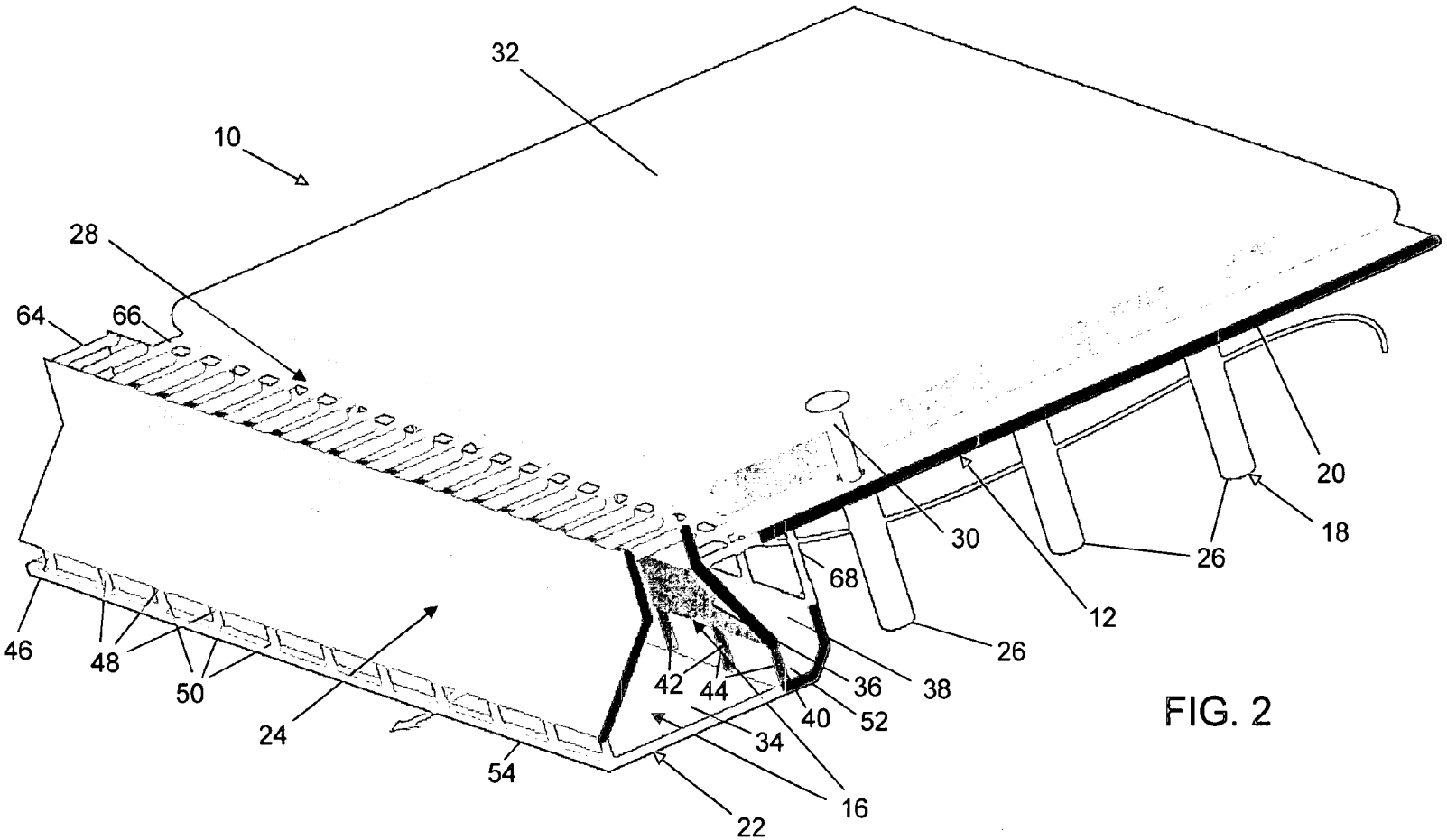
FIG. 2 is a perspective view of a one-sided ridge vent according to this invention.

Vent support 18 extends from the roof 14 and may contain a single piece of material or may be a series of hollow columns 26 extending from the roof 14 as shown in FIG. 2. Commonly, support 18 consists of a series of round columns 26 spaced apart from one another to allow air to pass through the support 18. Alternatively, support 18 could be a series of various shaped units spaced apart from one another. Another common form of the support 18 is a firm, porous material such as polypropylene that may be rolled onto the roof 14. The support 18 may be made of plastic, vinyl, aluminum, polypropylene, or other materials known in the art.

Vent cover 20 attaches to the top of support 18 and extends from the peak of the roof 14 to a termination end 28 as shown in FIG. 1. Cover 20 extends along the width of the roof 14 and above vent 12. Support 18 spaces cover 20 above vent 12. Cover 20 may contain holes above the support columns 26 to allow a nail or screw 30 to secure the cover 20 and support 18 to the roof 14 as shown in FIG. 2. In addition, cover 20 may be shingled to blend in with the rest of the roof 14. Cover 20 may also be made of plastic, vinyl, aluminum or other materials known in the art. Vent support 18 and cover 20 are conventional and are typically sold as a unit. A ridge vent manufactured under the name Cobra Rigid Vent II™ by GAF Materials Corporation is an example of a ridge vent having a vent cover integral to a support. The teachings of the Cobra Rigid Vent II™ can be found in http://www.gaf.com/Content/GAF/RES1/ROOF/V_RidgeVents.pdf and are incorporated herein by reference.

The ridge vent assembly 10 allows air to enter vent 12 while preventing debris and water from entering vent 12. The ridge vent assembly 10 also provides a concealed biocidal source generally indicated at 16 to inhibit the growth of unwanted biological matter on the roof 14. Specifically, support 18 spaces cover 20 above the roof 14 and above vent 12. Support 18 also allows air to pass through ridge vent assembly 10 and vent 12. Cover 20 prevents water and debris from entering vent 12. Cover 20 also acts to conceal the ridge vent assembly 10, especially when cover 20 is shingled to match the roof 14. Additionally, cover 20 allows rainwater to run from the peak of the roof 14 to the termination end 28 of cover 20. Alternatively, a mesh material, typically made of fiberglass, may be packed around support 18 and below cover 20 to prevent debris, blowing snow, and insects from entering vent 12. The mesh material is permeable, however, and allows air to enter vent 12.

Referring to FIG. 2, housing 22 is located downstream of the cover 20 and is adapted to receive rainwater running off cover 20. Housing 22 includes a base 34, a diverter 36, at least one biocidal source 16, and a splash wall 38. Housing 22 is ideally integral with cover 20, but could be installed next to cover 20 as a separate unit. Base 34 rests on the roof 14 and has a first end 52 located adjacent to cover 20 and a spaced-apart second end 54. The splash wall 38 connects to the first end 52 of base 34 and extends toward cover 20. Diverter 36 connects to base 34 via a middle support 40 connected near or at the first end 52 of base 34. Middle support 40 is comprised of a series of posts 42 extending up from base 34 to diverter 36. Alternatively, middle support 40 could have as few as just one post 42 supporting diverter 36. Posts 42, diverter 36, and base 34 define air and water passages 44. Middle support 40 and diverter 36 may alternatively be comprised of a single unit containing apertures, slots, cutouts, or other openings near base 34 to allow air and water to pass. Diverter 36 extends up from middle support 40 to a point adjacent cover 20. Optionally, diverter 36 may connect directly to base 34, and may contain apertures to allow air to pass through it. The apertures may be vented or slotted towards base 34 so that air may pass through the apertures, but rainwater flowing down diverter 36 will not pass through the apertures. Alternatively, diverter 36 may be comprised of a mesh, netting, or a porous material that will allow both air and some water to pass through.

A biocidal source 16, such as zinc, lead, copper, other ionic metals, or other biocides known in the art, is fastened on at least one of base 34 and diverter 36. Base 34 and diverter 36 may be composed of the biocide. Alternatively, biocidal source 16 could be attached to base 34 and diverter 36 by being embedded in, fastened to, adhered to, sprayed on, or by other means known in the art. Housing 22 and its components may be composed of plastic, vinyl, aluminum, a biocidal source 16, or other materials known in the art.

Concealing structure 24 attaches to the second end 54 of base 34 by a front support 46 as shown in FIG. 2. Front support 46 is comprised of a series of posts 48 extending up from base 34 to diverter 36. Alternatively, front support 46 could have as few as just one post 48 supporting diverter 36. Posts 48, concealing structure 24, and base 34 define air and water passages 50. Front support 46 and concealing structure 24 may alternatively be comprised of a single unit containing apertures, slots, cutouts or other openings near base 34 to allow air and water to pass through. Concealing structure 24 extends from front support 46 to a point adjacent cover 20 and diverter 36. Concealing structure 24 may be composed of plastic, vinyl, aluminum or other materials known in the art. In addition, concealing structure 24 may be black in color, or the color may match the shingles 32 on the roof 14, or concealing structure 24 may include shingles.

Subsequently, cover 20 directs rain downward and into housing 22. Housing 22 also contains biocidal source 16 (FIG. 1) to inhibit the growth of unwanted biological matter. Specifically, biocidal source 16 is contained on at least one of base 34 and diverter 36. As water runs across biocidal source 16, the water dissolves some of the biocide and carries the biocide as the water continues to flow down the roof 14. The water disposes the biocide on the shingles 32 as the water flows down the roof 14. Once the biocide is in place, the biocide acts to inhibit the growth of unwanted biological matter on the shingles 32. Placing biocidal source 16 on both base 34 and diverter 36 has the advantage of reducing the length of base 34 needed to provide enough biocide for the length of a given roof. As mentioned, approximately a one-inch wide strip of biocidal source 16 is needed to provide sufficient coverage for approximately a ten-foot length of shingles below the source. Diverter 36 extends the length of the path of the water running off the vent cover 20. Therefore, adding biocidal source 16 to diverter 36 reduces the length of base 34 (covered in biocidal source 16) needed for the roof 14 of a given length Reducing the length of base 34 has the further advantage of reducing the visibility of housing 22, since base 34 determines the length of housing 22. A shorter housing 22 does not extend as far from cover 20. By including one or more diverters 36, one can make housing 22 more compact, and can make the biocidal function of housing 22 more efficient, because one can extend the water's path and expose more water to more biocidal surface area. Alternatively, diverter 36 may include a curved profile including one or more bends to provide a longer path and a larger biocidal surface.

Diverter 36 also reduces the amount of housing 22 that extends beyond cover 20 by redirecting water flowing off cover 20 towards the first end 52 of base 34. Diverter 36 is angled from a top end 56 disposed adjacent cover 20 to a bottom end 58 located beneath cover 20 and near the first end 52 of base 34 as shown in FIG. 1. Diverter 36 allows base 34 to be positioned below part of cover 20 by redirecting the water under cover 20, rather than allowing the water flowing off cover 20 to drop off cover 20 and onto base 34 directly. Water that flows off cover 20 falls onto diverter 36, flows down diverter 36 and drops onto base 34 near or at the first end 52 of base 34. Water is then able to flow back under diverter 36 and along base 34 through middle support 40. Again, diverter 36 reduces the visibility of housing 22 by reducing the amount of housing 22 that extends beyond the termination end 28 of cover 20.

Housing 22 also allows air to flow through ridge vent assembly 10 to vent 12. Air may pass below diverter 36 through middle support 40, through diverter 36 by way of the apertures, or between diverter 36 and cover 20 as shown in FIG. 2. Moreover, air may pass between splash wall 38 and cover 20. Diverter 36 also prohibits the flow of water through its apertures. Diverter 36 contains ridges above the apertures that angle the openings toward base 34. Water that flows down diverter 36 will flow down the ridges that are over the openings. Thus, water would have to flow uphill in order to flow under the ridges and into the apertures. Therefore, the ridges of the apertures prevent the flow of water into the apertures but still allow air to flow through diverter 36.

Additionally, splash wall 38 in housing 22 prevents water from flowing into vent 12. Splash wall 38 prevents water flowing off diverter 36 from continuing under cover 20 and beyond base 34 by creating a barrier at the first end 52 of base 34 as shown in FIG. 2. If water were able to flow past base 34, the water could damage unprotected wood below cover 20, enter vent 12, and damage the inside of the building.

At the opposite end of housing 22, concealing structure 24 hides biocidal source 16 as shown in FIG. 2. Without concealing structure 24, biocidal source 16 on base 34 would be visible to observers. The concealing structure 24 also acts to blend housing 22 with the rest of the ridge vent assembly 10. Typically, ridge vent assembly 10 has a black plastic strip located adjacent to the termination end 28 of cover 20. The black strip tends to look like a shadow to observers. Concealing structure 24 acts like the black strip of a standard ridge vent, and provides a shadow effect that conceals housing 22 and biocidal source 16 on housing 22. Concealing structure 24 can further blend with the shingles 32 on the roof 14 by containing a color matched to the shingles' 32 color. Additionally, front support 46 below concealing structure 24 allows water to run onto the roof 14 from housing 22. Front support 46 provides passages 50 for the water to exit housing 22 by passing under concealing structure 24. Moreover, front support 46 prevents streaking caused when water does not flow evenly along the roof 14. Front support 46 prevents streaking by providing narrow posts 48 and wide openings for water to flow out of housing 22. When the water passes through front support 46 onto the roof 14, the water covers nearly the entire width of the roof 14 and little or no streaking occurs. Additionally, posts 48 may be rounded to provide better water coverage on roof 14 directly below front support 46. Rounded posts 48 allow water running through front support 46 to cling to the posts 48 as the water continues to flow down the roof 14. Therefore rounded posts 48 prevent gaps in water coverage directly in front of posts 48 that may occur if the posts are rectangular.

Figure 3:
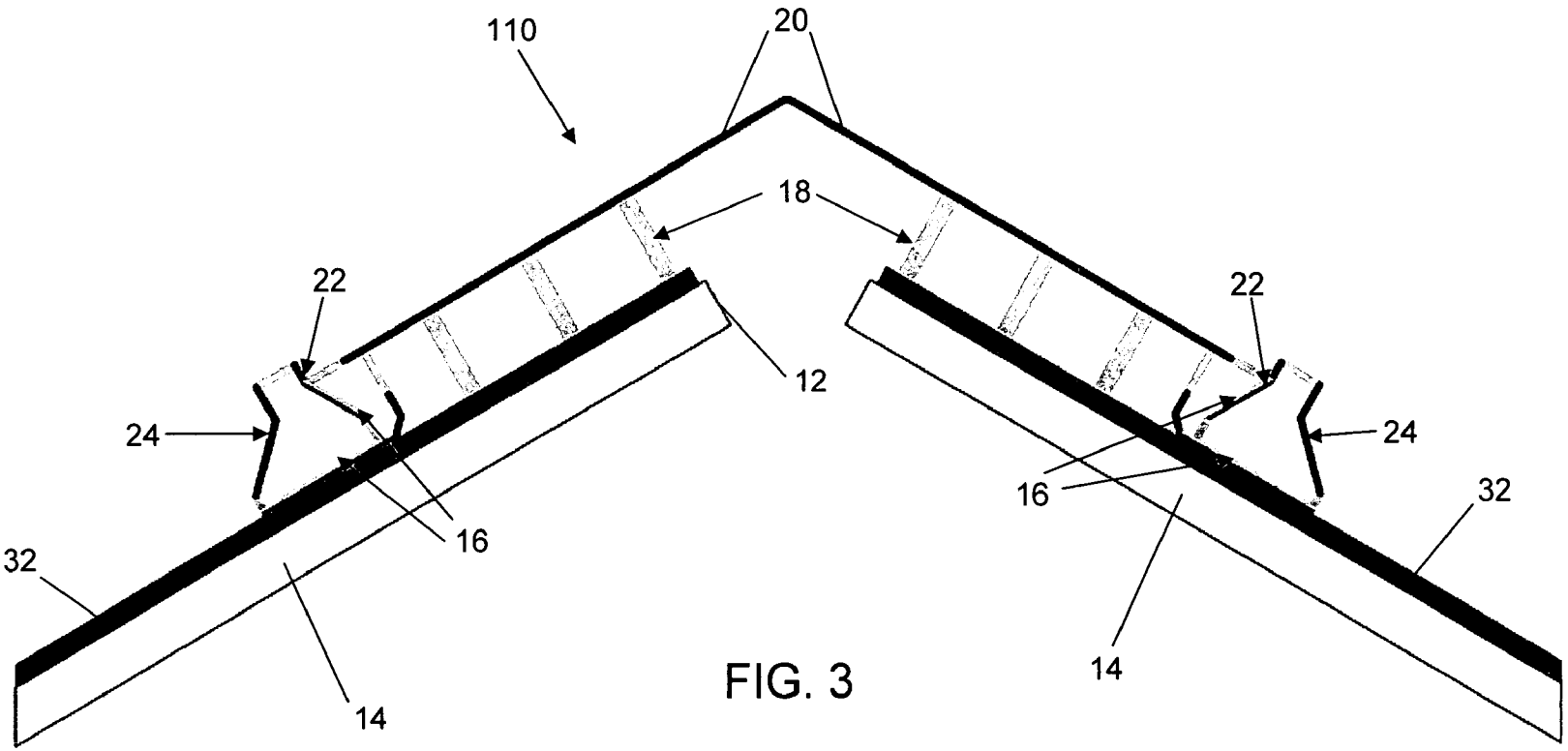
FIG. 3 is a sectional view of a two-sided ridge vent installed over the peak of a roof.

Additional features may be included in the invention to provide further advantages. For example, ridge vent assembly 10 has been described thus far focusing on a single side of the ridge vent assembly 10. Typically, however, ridge vents can be a two-sided unit for use over a peak of the roof 14 as shown in FIG. 3. As can be seen in FIG. 3, ridge vent assembly 110 has two equal sides that meet at the peak of the roof 14. Ridge vent assembly 110 is flexible so that it may be installed on a variety of roof pitches. Additionally, two-sided ridge vent assembly 110 may be installed on a hip of the roof to provide biocide for the areas of a roof below the hip.

Figure 4:
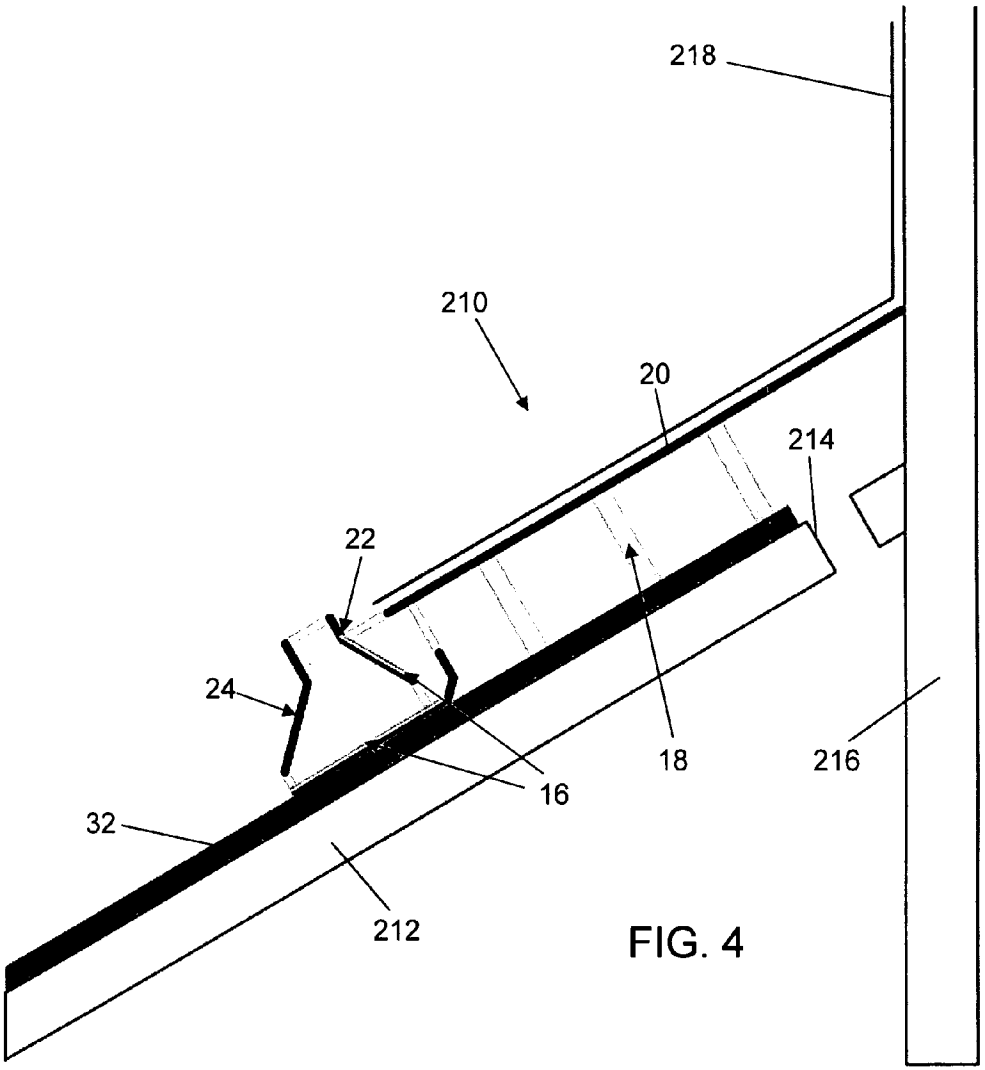
FIG. 4 is sectional view of a one-sided ridge vent installed over a wall vent.

Alternatively, ridge vent assembly 210 may be a single-sided unit as shown in FIG. 4. Single-sided ridge vent assembly 210 may be used for wall vents 214 as shown in FIG. 4. Wall vents 214 are commonly used when a shingled roof or porch 212 meets with a wall 216 of a building. FIG. 4 shows cover 20 of ridge vent assembly 210 butted against the wall 216 and over wall vent 214. A flashing 218 is installed over cover 20 to prevent water from getting between cover 20 and wall 216. As with a roof vent, ridge vent 210 allows air to reach the wall vent 214. Water that flows off cover 20 and through housing 22 will contain some of the biocide from housing 22 and will continue down the shingled roof or porch 212 depositing biocide along the way. Thus, ridge vent assembly 210 for a wall vent configuration will inhibit the growth of unwanted biological matter.

Grates are another optional feature of ridge vent assembly 10. As shown in FIG. 2, a first grate 64 may be placed between concealing structure 24 and diverter 36, and a second grate 66 may be placed between diverter 36 and cover 20. The first grate 64 and second grate 66 are support structures prohibit debris from entering and clogging housing 22. In addition, the first grate 64 and second grate 66 allow rain to enter housing 22 to provide additional water to carry biocidal source 16 to the shingles 32 below. The first grate 64 and second grate 66 also provide support for concealing structure 24 and housing 22. Likewise a rear support 68 may be added between splash wall 38 and cover 20 to provide additional support to both housing 22 and cover 20.

Another alternative is to connect diverter 36 directly to the termination end 28 of cover 20 and connect diverter 36 directly to base 34. This alternative also eliminates middle support 40, splash wall 38, and rear support 68. Water that flows down cover 20 will flow down the front side of diverter 36 because diverter 36 directly connects to cover 20. The surface tension of water allows the water to flow down diverter 36 and onto base 34. In this alternative, diverter 36 also acts to prevent water from continuing up under cover 20 and beyond base 34 by creating a barrier at the first end 52 of base 34.

Additionally the invention involves a corresponding method for controlling growth of biological matter on the roof 14. The method includes disposing the biocidal source 16 downstream of the ridge vent and housing 22 the biocidal source in a perforated housing 22 so that water running off the ridge vent contacts the biocidal source before continuing down the roof 14. Additionally, concealing the biocidal source 16 with a concealing structure 24 minimizes visibility of the biocidal source. Furthermore, the method may include extending the path of the water after it runs off the ridge vent, and disposing the biocidal source 16 along that path.

Obviously, many modifications and variations of the present invention are possible in light of the above teachings. Therefore, it is to be understood that within the scope of the appended claims the invention may be practiced otherwise than as specifically described. Moreover, the reference numerals are merely for convenience and are not intended to be in any way limiting.

We claim:

1. A biocidal structure for use with a roofing ridge vent, the structure comprising:

a housing;

a biocidal source carried by the housing; and a concealing structure disposed adjacent the biocidal source and composed of material other than the biocidal source to hide the biocidal source and minimize visibility of the ridge vent assembly on the roof, wherein the housing includes:

a base having a first end for placing adjacent the ridge vent, and a spaced-apart second end;

a diverter disposed on the base adjacent the first end and extending up from the base and towards the second end for directing water running off the ridge vent to flow across the base from the first end toward the second end;

the biocidal source disposed on at least one of the base and the diverter; and a splash wall connected to the base at the first end for preventing water from entering the ridge vent.

2. The biocidal structure of claim 1 wherein the diverter further includes at least one aperture such that air can pass through the diverter.

3. The biocidal structure of claim 1 wherein the first end of the base is disposed downstream of the ridge vent.

4. The biocidal structure of claim 1 wherein the concealing structure is supported by the base.

5. The biocidal structure of claim 4 wherein the concealing structure contains at least one aperture such that water can pass through the concealing structure.

6. The biocidal structure of claim 1 further including at least one grate extending over the housing to prevent debris from inhibiting water from flowing across the biocidal source.

* * * * *